US009775421B2

(12) United States Patent
Kim

(10) Patent No.: US 9,775,421 B2
(45) Date of Patent: Oct. 3, 2017

(54) AIRLESS COMPACT CONTAINER

(71) Applicant: YONWOO CO., LTD., Incheon (KR)

(72) Inventor: You-Seob Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/910,592

(22) PCT Filed: Aug. 5, 2014

(86) PCT No.: PCT/KR2014/007197

§ 371 (c)(1),
(2) Date: Feb. 5, 2016

(87) PCT Pub. No.: WO2015/020391

PCT Pub. Date: Feb. 12, 2015

(65) Prior Publication Data

US 2016/0192761 A1 Jul. 7, 2016

(30) Foreign Application Priority Data

Aug. 6, 2013 (KR) ..... 10-2013-0092932

(51) Int. Cl.
*B67D 7/84* (2010.01)
*A45D 40/00* (2006.01)
(Continued)

(52) U.S. Cl.
CPC ..... *A45D 40/0075* (2013.01); *A45D 33/008* (2013.01); *A45D 34/04* (2013.01);
(Continued)

(58) Field of Classification Search
CPC ..... A45D 40/0075; A45D 33/008
(Continued)

(56) References Cited

U.S. PATENT DOCUMENTS 6,309,124 B1 * 10/2001 Gueret ..... A45D 34/045 401/123
2005/0231835 A1 * 10/2005 Tokushita ..... A45D 33/006 359/871

(Continued)

FOREIGN PATENT DOCUMENTS

KR 20-0372911 Y1 1/2005
KR 2012-0104688 A 9/2012
KR 101223827 B1 1/2013

OTHER PUBLICATIONS

International Search Report issued in PCT/KR2014/007197 dated Nov. 13, 2014.

*Primary Examiner* — Patrick M Buechner
*Assistant Examiner* — Michael J Melaragno
(74) *Attorney, Agent, or Firm* — Marshall, Gerstein & Borun LLP

(57) ABSTRACT

Provided is an airless compact container. The airless compact container blocks air from flowing into a refill container through a pumping member and thus prevents contents from being corrupted by inserting the refill container provided with the pumping member into one side of a middle case and then allowing contents to be discharged to the upper surface of a content outlet part through the pumping operation of the pumping member when a user pressurizes the lower end portion of the refill container.

5 Claims, 3 Drawing Sheets

(51) Int. Cl.

| | |
|---|---|
| ***A45D 33/00*** | (2006.01) |
| ***A45D 34/04*** | (2006.01) |
| ***B05B 11/00*** | (2006.01) |
| *A45D 34/00* | (2006.01) |

(52) U.S. Cl.
CPC ..... *B05B 11/0054* (2013.01); *B05B 11/3047* (2013.01); *A45D 2034/005* (2013.01); *A45D 2200/056* (2013.01)

(58) Field of Classification Search
USPC ..... 222/173
See application file for complete search history.

(56) References Cited

U.S. PATENT DOCUMENTS

2012/0006853 A1* 1/2012 Lim ..... A45D 40/0075 222/256
2012/0267398 A1* 10/2012 Lim ..... A45D 34/04 222/256
2012/0305606 A1* 12/2012 Lee ..... A45D 33/02 222/256
2016/0015149 A1* 1/2016 Kim ..... A45D 34/00 222/383.1
2016/0073761 A1* 3/2016 Lee ..... A45D 33/025 132/298
2016/0150868 A1* 6/2016 Jung ..... A45D 34/04 222/562
2016/0157581 A1* 6/2016 Kim ..... A45D 34/04 222/386
2016/0157582 A1* 6/2016 Jung ..... A45D 40/0075 222/383.1
2016/0192761 A1* 7/2016 Kim ..... A45D 33/008 222/173

* cited by examiner

[Fig. 1]
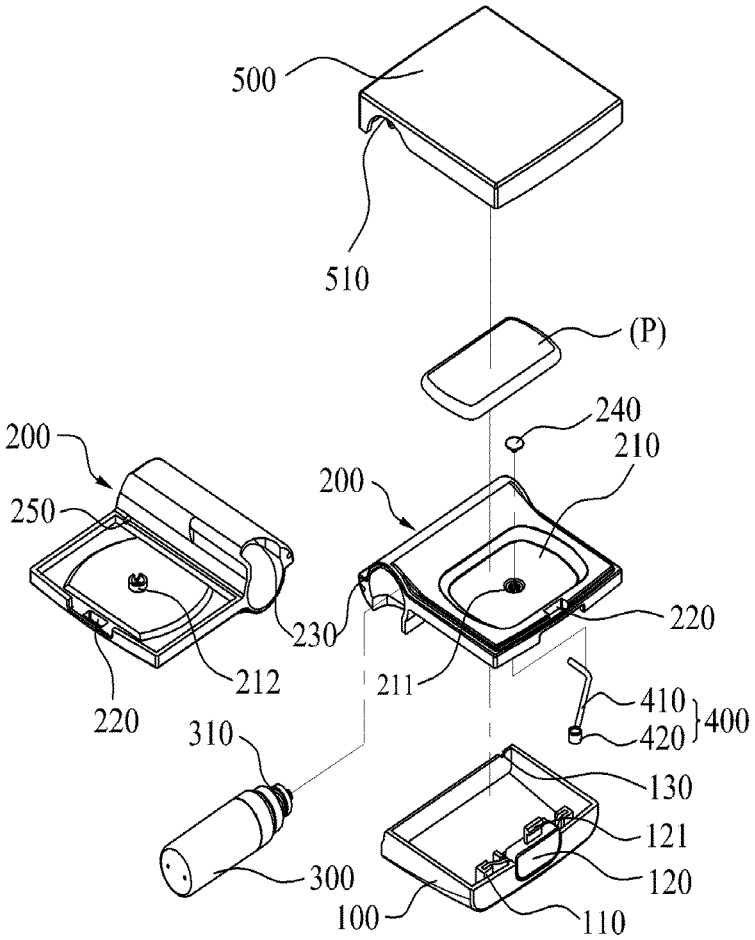
[Fig. 2]
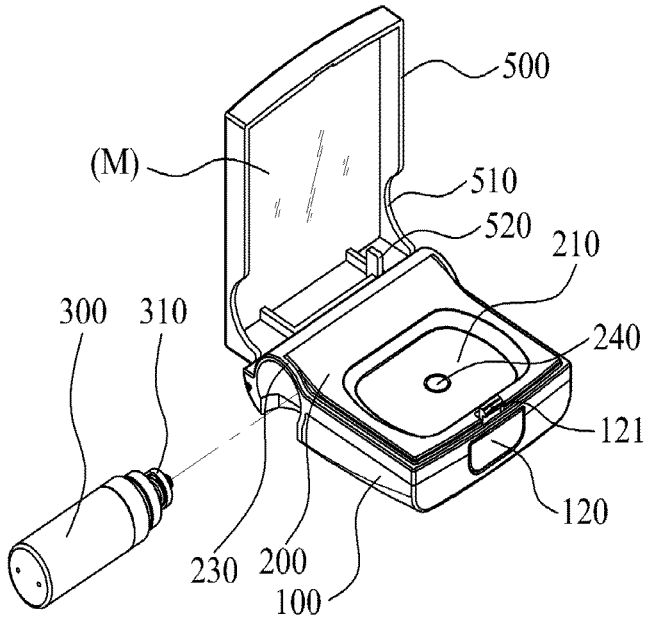

[Fig. 3]
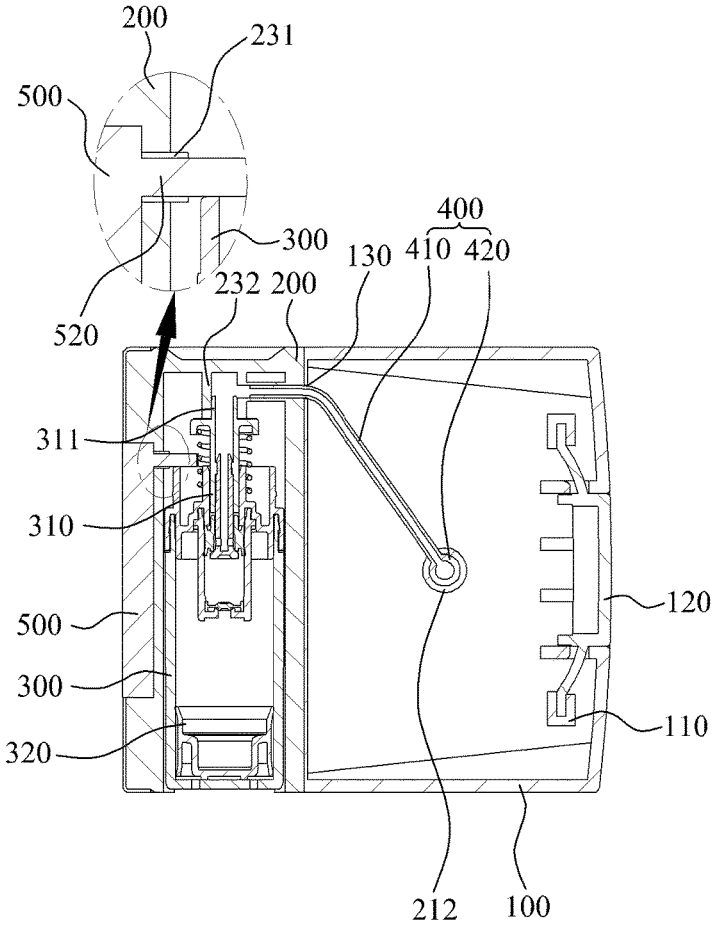
[Fig. 4]
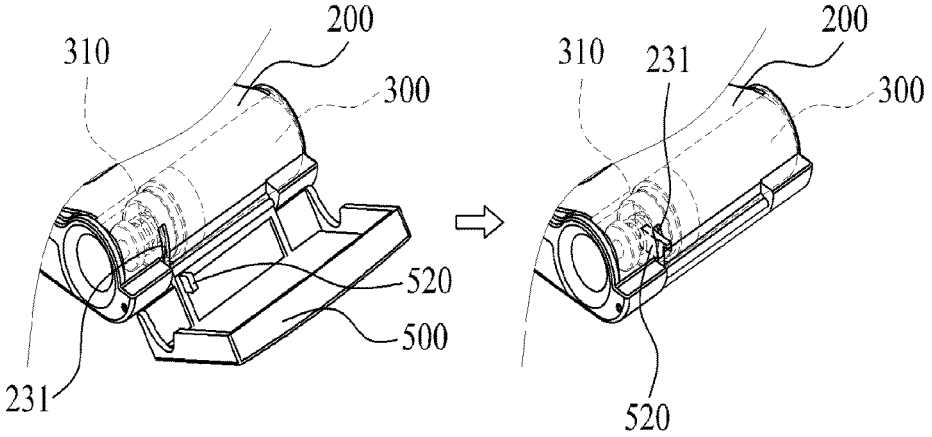

[Fig. 5]
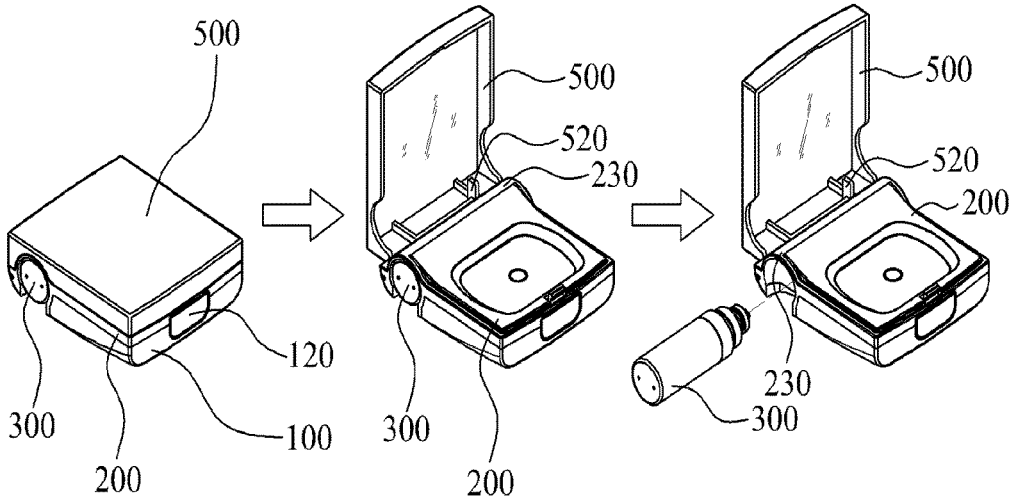
[Fig. 6]
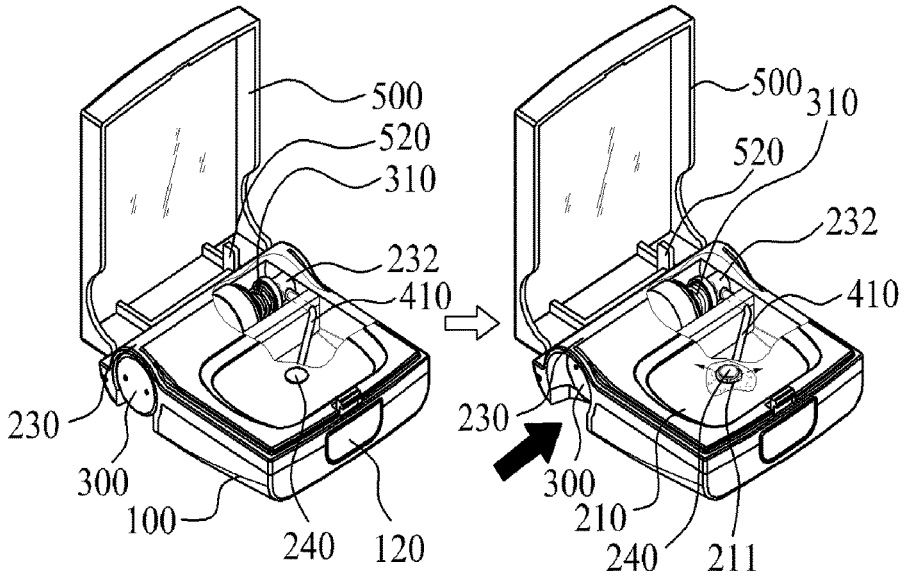

AIRLESS COMPACT CONTAINER

CROSS-REFERENCE TO RELATED APPLICATIONS

This U.S. non-provisional patent application claims priority under 35 U.S.C. §119 of Korean Patent Application No. 10-2013-0092932 filed on Aug. 6, 2013, the entire contents of which are hereby incorporated by reference.

BACKGROUND OF THE INVENTION

The present invention disclosed herein relates to an airless compact container, and more particularly, to an airless compact container which can block air from flowing into a refill container through a pumping member and thus prevent contents from being corrupted by inserting the refill container provided with the pumping member into one side of a middle case and then allowing contents to be discharged to the upper surface of a content outlet part through the pumping operation of the pumping member when a user pressurizes the lower end portion of the refill container.

Generally, a compact container refers to an article that stores color cosmetics or powder used for facial makeup while women are conveniently carrying the article.

The compact containers are being provided in various shapes, and stores contents of power or color cosmetics regardless of their shape. When a user uses the compact containers, a user pressurizes a button provided on the front surface portion of the container body to open the external cover from the container body by hinge pivoting, and applies cosmetics for facial makeup using cosmetic tools such as a puff or a brush contained in the container body.

Typical compact containers are configured to maintain internal airtightness by covering the upper end portion of the content storage part through an inner cap. In this case, it is possible to block air from flowing into the inside to a certain extent, but internal airtightness cannot be perfectly maintained due to a structural limitation.

Recently, various attempts to contain and discharge liquid contents in/out of the compact container while blocking the inflow of air are being conducted. Korean Patent No. 10-1236050 discloses a "compact type cosmetics container with airtight function", which stores and discharges liquid contents.

This patent relates to a compact type airtight cosmetic container including a lower body (10), an upper body (20) coupled to the upper portion of the lower body and performing up/down opening/closing by a hinge (21) at one side and locking or locking release by a locker (220) at the other side, a middle body (30) containing dry or wet powder or liquid power cosmetics inside the lower body, a shoulder cap (40) inserted into and seated on the upper portion of the middle body and fixedly coupled to a mesh (45) by a fixing ring (46) under a through hole (41) at the internal center, and a puff receiving cap (50) inserted into and seated on the upper portion of the shoulder cap and receiving a puff (56) in a spatial part (55) at the upper center.

Also, an airtight member (51) is coupled to the lower portion of the puff receiving cap (50) to airtightly block the through hole (41) of the shoulder cap (40), and an airtight ring (43) is installed in a seating groove (42) of the shoulder cap (40) inserted into and seated on the outer circumference of the upper end of the middle body (30). In this case, the airtight property is increased by pressurizing the puff receiving cap (50) at the upper portion of the middle body (3) using a pressurizing unit (60) and thus pressurizing the airtight member (51) and the airtight ring (43).

However, the above-mentioned registered patent includes a complicated structure for improving the airtight property and thus incurs an increase of the manufacturing cost. Also, the refill configuration is complicated, and thus is inconvenient for use.

SUMMARY OF THE INVENTION

The present invention provides an airless compact container which can block air from flowing into a refill container through a pumping member and thus prevent contents from being corrupted by inserting the refill container provided with the pumping member into one side of a middle case and then allowing contents to be discharged to the upper surface of a content outlet part through the pumping operation of the pumping member when a user pressurizes the lower end portion of the refill container.

The present invention also provides an airless compact container which is configured to enable a refill container containing liquid contents and provided with a pumping member at the upper portion thereof to be inserted into and withdrawn from one side of a middle case, and thus can achieve simple refill and user convenience.

Embodiments of the present invention provide airless compact containers including: a lower case including a button part coupled thereto for opening/closing of an upper case; a middle case coupled to the lower case and including a content outlet part having a content outlet hole formed therein and a container receiving part formed at one side thereof to allow a refill container to be inserted into and withdrawn from the container receiving part; a refill container storing contents, inserted into and withdrawn from the container receiving part, and including a pumping member integrally formed on an upper portion thereof and discharging stored contents by an pumping operation; a nozzle part moving contents discharged through the pumping member to the content outlet hole; and an upper case coupled to the middle case by a hinge and opened in accordance with an operation of the button part, wherein when a lower end portion of the refill container is pressurized, the refill container moves forward in the container receiving part, and thus the pumping operation of the pumping member is performed to allow contents to be discharged to the content outlet part.

In some embodiments, in the upper case may include a limitation protrusion formed on an inner side of the upper case and limiting the pumping operation of the pumping member by supporting the upper portion of the refill container when the upper case is closed and thus preventing the refill container from moving.

In other embodiments, the container receiving part may have a protrusion insertion groove formed therein such that the limitation protrusion is inserted into the protrusion insertion groove when the upper case pivots and closes.

In still other embodiments, the middle case may include a nozzle fixing protrusion formed on a central portion of the undersurface of the middle case and downwardly extending so as to fix the nozzle part.

In even other embodiments, the nozzle part may include: a nozzle having a tubular shape and forming a movement passage of contents discharged through the pumping member; and a coupling protrusion coupled to the nozzle fixing protrusion by press-fitting at the end of the nozzle and including a lower end portion thereof closed such that contents moving through the nozzle upwardly moves to the content outlet hole.

In yet other embodiments, the container receiving part may include a pump fixing protrusion formed therein, coupled to an upper portion of the pumping member to fix the pumping member, and communicating with the nozzle part such that contents discharged through the pumping member move to the nozzle part.

In further embodiments, the lower case and the middle case may have a lower support groove and an upper support groove so as to support the nozzle part at a lower portion and an upper portion thereof, respectively.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIG. 1 is an exploded perspective view illustrating a configuration of an airless compact container according to an exemplary embodiment of the present invention;

FIG. 2 is a perspective view illustrating a configuration of an airless compact container according to an exemplary embodiment of the present invention;

FIG. 3 is a cross-sectional view illustrating a configuration of an airless compact container according to an exemplary embodiment of the present invention;

FIG. 4 is a view illustrating a coupling state of a protrusion insertion groove and a limitation protrusion according to opening/closing of an upper case of an airless compact container according to an exemplary embodiment of the present invention;

FIG. 5 is a view illustrating a refill process of an airless compact container according to an exemplary embodiment of the present invention; and FIG. 6 is a view illustrating an operational state of an airless compact container according to an exemplary embodiment of the present invention.

DETAILED DESCRIPTION OF PREFERRED EMBODIMENTS

Hereinafter, exemplary embodiments of the present invention will be described in detail with reference to the accompanying drawings. The same reference numerals provided in the drawings indicate the same members.

FIG. 1 is an exploded perspective view illustrating a configuration of an airless compact container according to an exemplary embodiment of the present invention. FIG. 2 is a perspective view illustrating a configuration of an airless compact container according to an exemplary embodiment of the present invention. FIG. 3 is a cross-sectional view illustrating a configuration of an airless compact container according to an exemplary embodiment of the present invention.

FIG. 4 is a view illustrating a coupling state of a protrusion insertion groove and a limitation protrusion according to opening/closing of an upper case of an airless compact container according to an exemplary embodiment of the present invention. FIG. 5 is a view illustrating a refill process of an airless compact container according to an exemplary embodiment of the present invention.

Referring to FIGS. 1 to 5, an airless compact container according to an exemplary embodiment of the present invention may include a lower case 100, a middle case 200, a refill container 300, a nozzle part 400, and an upper case 500.

The lower case 100 may include a button part 120 for opening/closing the upper case 100, and a button supporting part 110 for supporting the button part 120.

The button part 20 may be coupled to a front surface portion of the lower case 100, and may prevent the upper case 500 from being opened at ordinary time. When a user pressurizes the button part 120, the button part 120 may move in an inner side direction, and may enable the upper case 500 to be opened. The button part 120 may include a stopping protrusion 121 disposed on the upper portion of the button part 120. The stopping protrusion 121 may support the inner side of the upper case 500 when the upper case 500 is closed, and may prevent the upper case 500 from being opened.

Meanwhile, a lower support groove 130 may be formed on the upper end of the rear surface portion of the lower case 100, and may support the lower portion of the nozzle part 400 such that the nozzle part 400 can penetrate through the lower support groove 130.

The middle case 200 may be coupled to the upper portion of the lower case 100. The middle case may include a content outlet part 210 having a content outlet hole 211 formed in the central portion of the content outlet part 210 so as to discharge contents. The content outlet part 210 may be downwardly concaved such that a content application member such as puff P can be seated thereon.

Also, a rubber tip 240 may be disposed in the content outlet hole 211 to prevent contents from being suddenly discharged.

In this embodiment, a container receiving part 230 may be provided on one side of the middle case 200 to form a space such that the refill container 300 can be inserted into and withdrawn from the container receiving part 230. The container receiving part 230 may be formed into various shapes in accordance with the refill container 300 so as to receive the refill container 300.

A protrusion insertion groove 231 may be formed in the container receiving part 230 such that a limitation protrusion 520 of the upper case 500 is inserted into the protrusion insertion groove 231 when the upper case 500 pivots and is closed.

A pump fixing protrusion 232 to which the upper portion of a pumping member 310 is coupled by press-fitting may be provided in the container receiving part 230. The pump fixing protrusion 232 may be configured to be coupled to one side of the nozzle part 400 and mutually communicate with each other, thereby enabling contents discharged through the pumping member 310 to move to the nozzle part 400.

Meanwhile, a through hole 220 may be formed in the front surface portion of the middle case 200 such that the stopping protrusion 121 of the button part 120 can penetrate the through hole 220.

Also, a nozzle fixing protrusion 212 downwardly extending may be provided on the central portion of the undersurface of the middle case 200 so as to fix the nozzle part 400 thereto. The nozzle fixing protrusion 212 may be cut at one side thereof such that a nozzle 410 of the nozzle part 400 penetrates the nozzle fixing protrusion 212. The lower end portion of the nozzle fixing protrusion 212 may be opened such that a coupling protrusion 420 of the nozzle part 400 can be coupled to a lower portion of the nozzle fixing protrusion 212.

Also, an upper support groove 250 may be formed on the lower end of the rear surface portion of the middle case 200. The upper support groove 250 may be disposed directly over the lower support groove 130, and may support the upper portion of the nozzle part 400.

The refill container 300 may store liquid contents, and may include a pumping member 310 integrally formed thereon. The pumping member 310 may discharge contents stored in the refill container 300 by a pumping operation.

In this embodiment, the refill container 300 may be configured to be inserted into and withdrawn from the container receiving part 230. Thus, when contents stored in the refill container 300 runs out, a user may simply replace the refill container 300.

The replacement of the refill container 300, as shown in FIG. 5, may be simply performed by pivoting and opening the upper case 500 to one side, holding and withdrawing the vacant refill container 300 from the container receiving part 230, and then inserting a new refill container 300 filled with contents into the container receiving part 230.

Meanwhile, the refill container 300 may be configured to be fixed in the container receiving part 230 by coupling a stem 311 constituting the upper portion of the pumping member 310 to the pump fixing protrusion 232 by press-fitting.

Also, a piston 320 may be disposed in the refill container 300. The piston 320 may ascend by use of contents according to the pumping operation of the pumping member 310.

The nozzle part 400, which moves contents discharged through the pumping member 310 to the content outlet hole 211, may include a nozzle 410 and a coupling protrusion 420.

The nozzle 410 may have a tubular shape that forms a movement passage of contents discharged through the pumping member 310. The nozzle 410 may penetrate a space defined by the lower support groove 130 and the upper support groove 250, and may be configured to have one side thereof coupled to the pump fixing protrusion 232 and the other side thereof coupled to the nozzle fixing protrusion 212.

The coupling protrusion 420 may be disposed at the end of the nozzle 410, and may be coupled to the nozzle fixing protrusion 212 by press-fitting. The coupling protrusion 420 may be configured to include the lower end portion thereof closed such that contents moving through the nozzle 410 can upwardly move to the content outlet hole 211.

The upper case 500 may be coupled to the middle case 200 by a hinge, and may be configured to upwardly pivot and open in accordance with the operation of the button part 120.

In this embodiment, the limitation protrusion 520 for limiting the pumping operation of the pumping member 310 by supporting the upper portion of the refill container 300 when the upper case 500 is closed and preventing the refill container 300 from moving may be disposed on the inner side of the upper case 500. When the upper case 500 is closed, the limitation protrusion 520 may be inserted into the protrusion insertion groove 231, and may support the upper portion of the refill container 300. Thus, even though the refill container 300 is pressurized, the refill container 300 may be blocked from moving. Accordingly, the pumping member 310 can be prevented from operating, and thus contents can be prevented from being unnecessarily discharged by an external pressure when a user does not desire.

Also, a curved part 510 matching with the upper end of the container receiving part 230 may be formed such that an interference with the upper end of the container receiving part 230 does not occur when the upper case 500 pivots downward to be closed.

Hereinafter, a method of using a refill container of an airless compact container according to an exemplary embodiment of the present invention will be described with reference to FIGS. 4 and 6.

Referring to FIGS. 4 and 6, the airless compact container may be opened when the button part 120 is pressurized and then the upper case 500 upwardly pivots. When the upper case 500 is opened, the limitation protrusion 520 of the upper case 500 may be separated from the protrusion insertion groove 231.

As described above, when the limitation protrusion 520 is separated from the protrusion insertion groove 231 and the lower end portion of the refill container 300 is pressurized, the refill container 300 may move forward in the container receiving part 230, and thus the pumping operation of the pumping member 310 may be performed. Thus, contents discharged through the pumping member 310 may move to the nozzle 410 through the inside of the pump fixing protrusion 232, and then contents moving through the nozzle 410 may be discharged to the upper surface of the content outlet part 210 through the content outlet hole 211.

When contents are discharged to the upper surface of the content outlet part 210, a user may apply contents through a content application member such as a puff P.

As described above, an airless compact container according to an embodiment of the present invention can block air from flowing into a refill container through a pumping member and thus can prevent contents from being corrupted by inserting the refill container provided with the pumping member into one side of a middle case and then allowing contents to be discharged to the upper surface of a content outlet part through the pumping operation of the pumping member when a user pressurizes the lower end portion of the refill container.

Also, the airless compact container may be configured to enable a refill container containing liquid contents and provided with a pumping member at the upper portion thereof to be inserted into and withdrawn from one side of a middle case, and thus can achieve simple refill and user convenience.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. An airless compact container comprising:

a lower case comprising a button part coupled thereto for opening/closing of an upper case;

a middle case coupled to the lower case and comprising a content outlet part having a content outlet hole formed therein and a container receiving part formed at one side thereof to allow a refill container to be inserted into and withdrawn from the container receiving part;

a refill container storing contents, inserted into and withdrawn from the container receiving part, and comprising a pumping member integrally formed on an upper portion thereof and discharging stored contents by an pumping operation;

a nozzle part moving contents discharged through the pumping member to the content outlet hole; and an upper case coupled to the middle case by a hinge and opened in accordance with an operation of the button part, wherein when a lower end portion of the refill container is pressurized, the refill container moves forward in the container receiving part, and thus the pumping operation of the pumping member is performed to allow contents to be discharged to the content outlet part, wherein the upper case comprises a limitation protrusion formed on an inner side of the upper case and limiting the pumping operation of the pumping member by supporting the upper portion of the refill container when the upper case is closed and thus preventing the refill container from moving, and wherein the container receiving part has a protrusion insertion groove formed therein such that the limitation protrusion is inserted into the protrusion insertion groove when the upper case pivots and closes.

2. The airless compact container of claim 1, wherein the middle case comprises a nozzle fixing protrusion formed on a central portion of the undersurface of the middle case and downwardly extending so as to fix the nozzle part.

3. The airless compact container of claim 2, wherein the nozzle part comprises:

a nozzle having a tubular shape and forming a movement passage of contents discharged through the pumping member; and a coupling protrusion coupled to the nozzle fixing protrusion by press-fitting at the end of the nozzle and comprising a lower end portion thereof closed such that contents moving through the nozzle upwardly moves to the content outlet hole.

4. The airless compact container of claim 1, wherein the container receiving part comprises a pump fixing protrusion formed therein, coupled to an upper portion of the pumping member to fix the pumping member, and communicating with the nozzle part such that contents discharged through the pumping member move to the nozzle part.

5. The airless compact container of claim 1, wherein the lower case and the middle case have a lower support groove and an upper support groove so as to support the nozzle part at a lower portion and an upper portion thereof, respectively.

* * * * *